US007111651B2

(12) United States Patent
Flynn

(10) Patent No.: US 7,111,651 B2
(45) Date of Patent: Sep. 26, 2006

(54) ENGINE COOLANT CHANGING SYSTEM

(75) Inventor: Robert E. Flynn, Covina, CA (US)

(73) Assignees: Robert A. Doty, Baldwin Park, CA (US); Kyung Ae Kim, Baldwin Park, CA (US)

( * ) Notice: Subject to any disclaimer, the term of this patent is extended or adjusted under 35 U.S.C. 154(b) by 0 days.

(21) Appl. No.: 10/926,538

(22) Filed: Aug. 25, 2004

(65) Prior Publication Data

US 2006/0042721 A1 Mar. 2, 2006

(51) Int. Cl.
*B65B 1/04* (2006.01)

(52) U.S. Cl. ..... 141/98; 141/65; 141/67; 141/92; 141/231

(58) Field of Classification Search ..... 141/59, 141/65, 67, 92, 94, 98, 231; 134/169 A; 165/95; 184/1.5
See application file for complete search history.

(56) References Cited

U.S. PATENT DOCUMENTS 4,793,403 A * 12/1988 Vataru et al. ..... 165/95
5,090,458 A * 2/1992 Creeron ..... 141/7
5,573,045 A * 11/1996 Akazawa ..... 141/92
5,853,068 A * 12/1998 Dixon et al. ..... 184/1.5
6,604,557 B1 8/2003 Awad

* cited by examiner

*Primary Examiner*—Timothy L. Maust
(74) *Attorney, Agent, or Firm*—Boniard I. Brown

(57) ABSTRACT

An engine cooling system liquid insertion and removal system has an adapter disposed in a vehicle radiator service opening via which old coolant is removed from the engine system by partial vacuum applied to an old coolant container via a conduit. New coolant is introduced via the adapter by atmospheric pressure from a portable container. Conduits interconnect the engine cooling system, the old and new coolant containers, and a source of partial vacuum applied to conduits.

15 Claims, 5 Drawing Sheets

ENGINE COOLANT CHANGING SYSTEM

BACKGROUND AND SUMMARY OF THE INVENTION

There has long existed a need for a coolant removal and replacement system which is multi-functional and provides prompt, efficient extraction of coolant and the insertion of new coolant in a vehicle engine system.

That is, there has existed a need for such a system which can accommodate the relatively simple function of extracting old coolant and the insertion of new coolant without requiring any coolant service apparatus which requires multiple tubes and other complications.

The present invention provides a single tube system preferably utilized with a multi-gallon portable container which enables the utilization of multiple types of coolant by simply replacing one container with another.

Prior art methods for removal and replacement of coolant have typically involved a cone-shaped adapter inserted in the vehicle radiator service opening, which arrangement does not allow the escape of air trapped in the coolant system, particularly when partial vacuum is employed to draw the coolant into the system. Radiator hoses must be disconnected and the adapter connected into the radiator hose. A problem presented is that many radiator hoses are not sufficiently rigid and therefore partially collapse upon the introduction of a partial vacuum into the system. Thus, only a part of the coolant is removable without substantial additional procedures and effort. Coolant must be removed from the engine by other means and air must be allowed to enter the system to enable a radiator hose to regain its uncollapsed condition. Coolant must then be installed and a new partial vacuum drawn on the system. Such procedures are time-consuming and can result in old coolant remaining in the engine system, with resultant incomplete fill and replacement of less than a full supply of coolant.

The present invention utilizes an adapter for vehicle radiator service openings so that coolant can be readily removed from the coolant system by partial vacuum which is provided by a service pump or preferably by a venturi. A limited introduction of atmospheric pressure greatly enhances the passage of coolant from a container into an engine system, without disconnecting or reconnecting any hose or conduit.

The apparatus according to the invention may utilize other liquids and coolants, such as cleaning solution or anti-freeze.

The system of the invention virtually insures against liquid spilling, which is relatively important in view of environmental regulations relative to the disposing of certain substances, such as antifreeze.

The invention is preferably utilized with a console whereon are mounted or attached components according to the invention, these including old and new coolant containers, conduits interconnecting an engine interior with an old coolant container, a portable new coolant container and conduit for insertion of new coolant into an engine by only atmospheric pressure. Means are provided for application of partial vacuum to an old coolant container to draw coolant from the engine to the container, and means are provided for application of atmospheric pressure to a new coolant container to urge the coolant into the engine.

DESCRIPTION OF THE PREFERRED EMBODIMENT

The present invention relates to systems for removal of old coolant from a vehicle engine and replacement thereof with new coolant.

The process of removing old coolant is accomplished by utilizing suction and partial vacuum at a venturi to provide a partial vacuum in tubes of the system of the invention, thereby insuring spill-free service which is essential in view of environmental concerns and EPA regulations regarding disposal of antifreeze compounds.

The present invention involves three embodiments and methods. The first and simpler method utilizes a storage tube and a venturi, with interconnecting hoses and valvings.

A second embodiment of the invention comprises the components of the first embodiment, and a removable container or bottle and connected with a pump.

A third or advanced embodiment utilizes the components of the first two embodiments, together with a stepped adapter for attachment to a radiator or hose.

Figures 1, 1A:
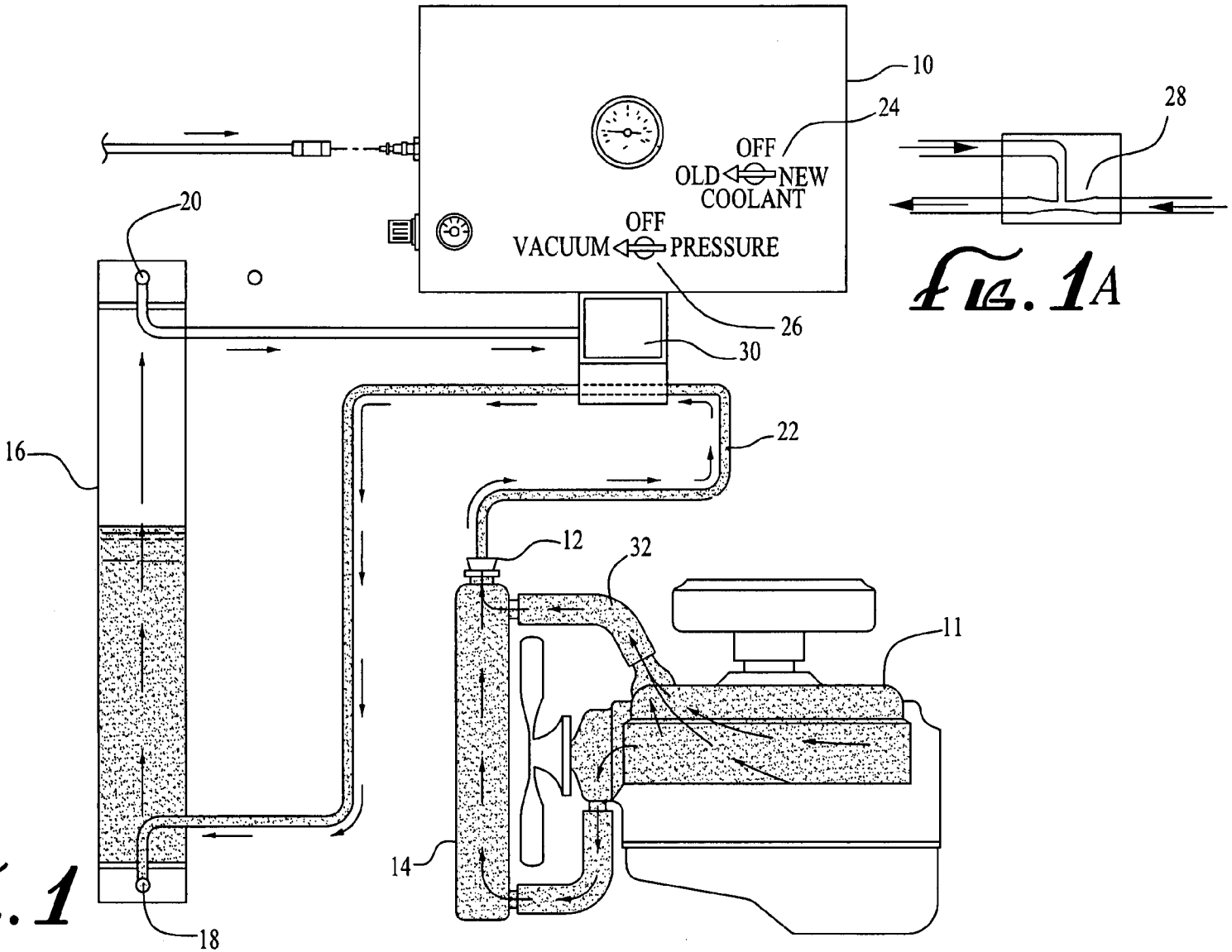
FIG. 1 is a diagrammatic showing of a system according to the invention for the removal of old coolant from a vehicle engine.
FIG. 1A is a fragmentary view of a venturi component of the system according to the invention.

Referring to the drawings, FIG. 1 shows a console 10 having components according to the invention mounted for convenient, efficient control, including valves and conduits having interconnections during operation of the system according to the invention.

Figure 2:
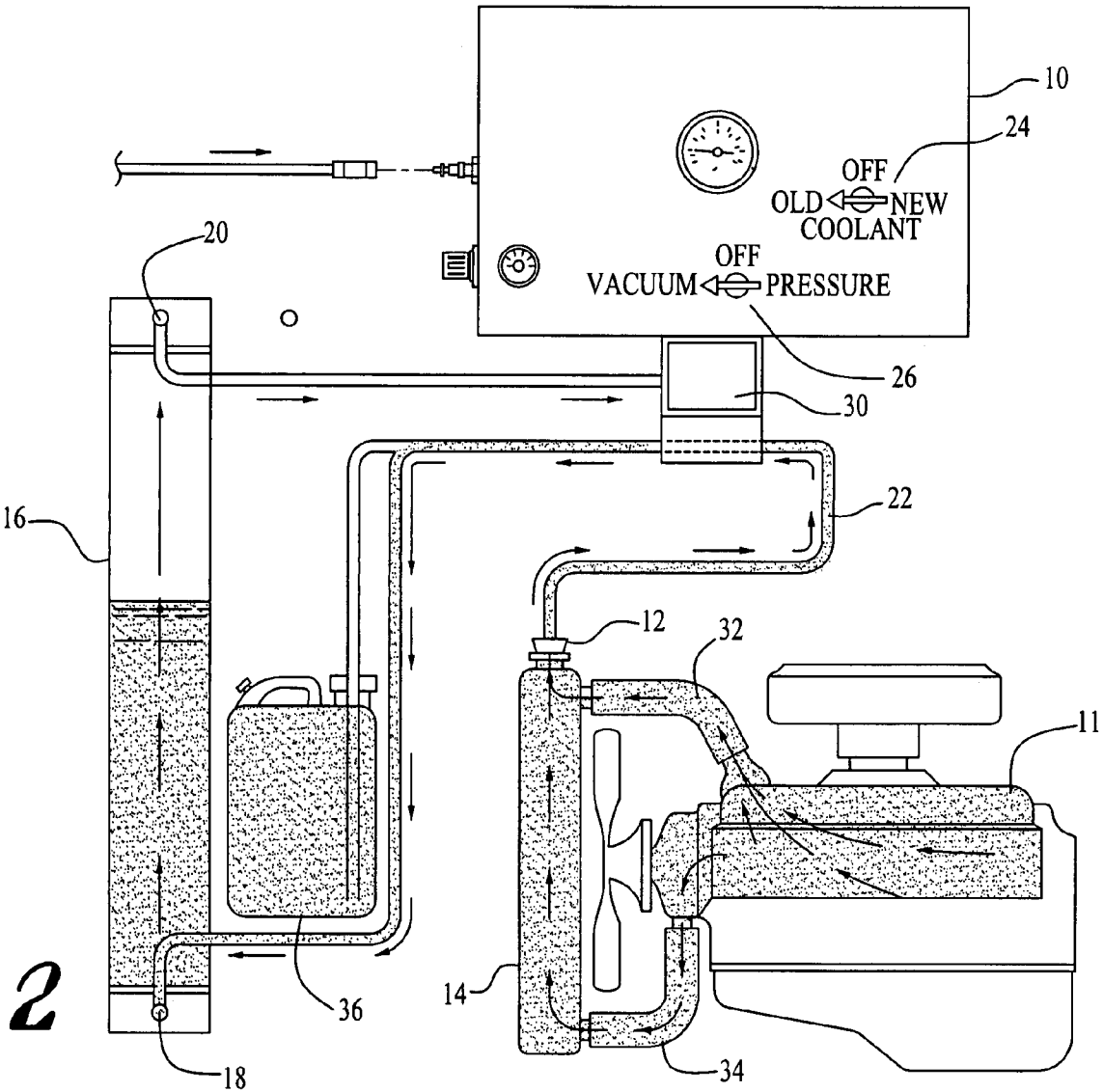
FIG. 2 is a diagrammatic showing of a modified system according to the invention for the removal of old coolant from a vehicle engine.
Figure 3:
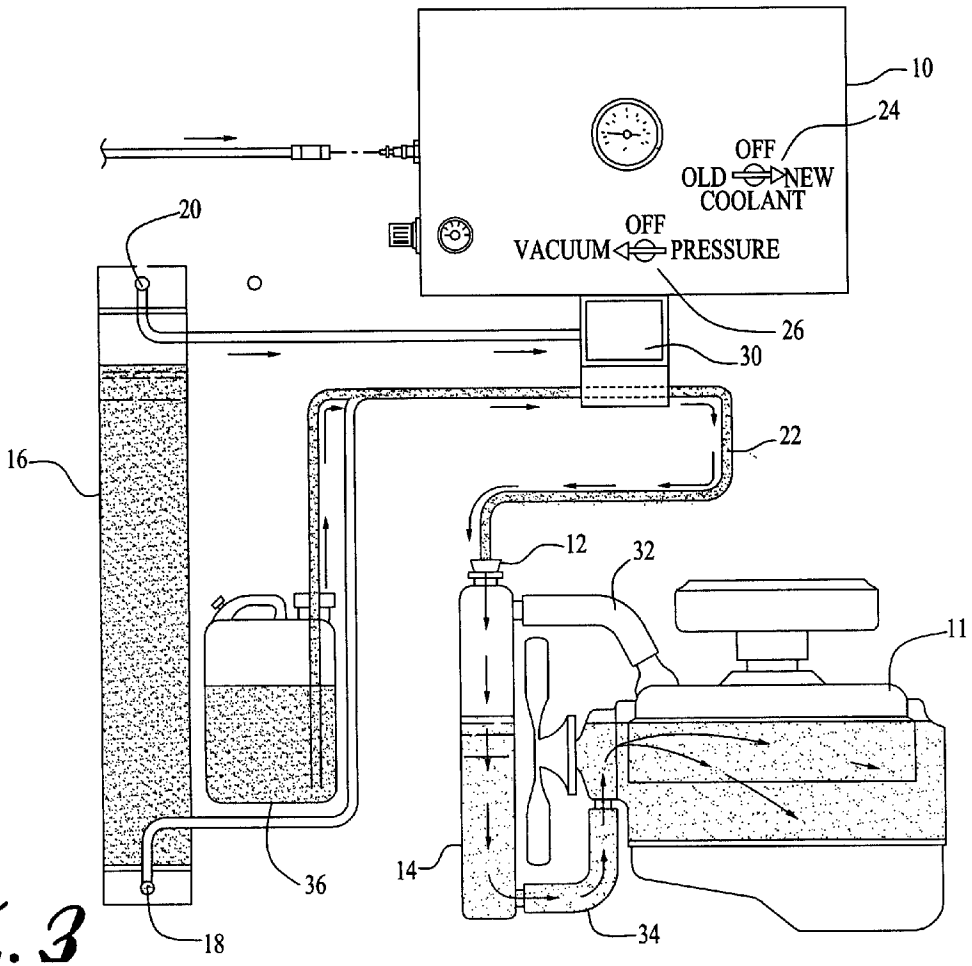
FIG. 3 is a diagrammatic showing of an arrangement of components for the insertion of new coolant into the vehicle engine.

FIGS. 2 and 3 collectively show the system according to the invention arranged for removal of coolant from a vehicle engine 11, and for the installing of new coolant into the engine.

An adapter 12 is installed in a service opening of the vehicle radiator 14, and is formed of a resilient material, typically rubber, and has an axial passage therethrough. A threaded end portion of a fluid conduit is disposed in an upper portion of the passage.

As shown in FIG. 1, the system comprises an old solution container or storage tube 16 having an inlet opening 18 in its lower portion, and an outlet opening 20 in its upper portion, as shown.

An old solution conduit 22 interconnects the engine interior via the adapter 12, conduit 22, and the inlet opening 18 of the old coolant container.

Control knobs 24 and 26 on the console 10 are operable to provide quick, efficient changes in liquid flow via valves and conduits of the system to operate valves to effect respective flow patterns via particular conduits, thus to provide for removal of old coolant from an engine, the insertion of new coolant into the engine, draining of old coolant, and filling of the system with a new coolant.

A partial vacuum for drawing old coolant from an engine is provided by a venturi 28, shown in FIG. 1A. The venturi is preferable for this purpose because it provides a higher degree of partial vacuum than a pump of similar size and capacity. It is in itself conventional, comprising a tube with a tapered restriction in its mid-portion to produce an increase in the velocity of fluid passing therethrough and a corresponding partial vacuum. The boiling point of the coolant may typically be reduced to 160° to 180° F., depending on the partial vacuum provided. Boiling causes water density to become lighter so that it can be readily pulled from the engine with the partial vacuum.

The present invention eliminates the disconnecting and/or reconnecting of fluid conduits during removal of old coolant and insertion of new coolant into an engine. Cleaning and flushing are accomplished in the removal of old coolant continuously during coolant changing.

The system preferably is operated with the engine running because it is not advisable to put cool coolant into a hot engine, although the engine system will operate with the engine not running.

Referring to FIG. 2, in a first method of operation, old coolant is removed by a partial vacuum at the suction side of the venturi 28 while the vehicle engine is running at idle speed. The partial vacuum drawn in at a vacuum generator 30 by the venturi 28 therein causes coolant in the radiator to boil at a low temperature, thereby vaporizing the coolant and enabling it to be drawn into the storage tube, which also has the partial vacuum therein.

An upper radiator hose 32 has a quick coupler affixed thereto. A variety of hose ending members or adapters may be attached in order that any type of coolant system may quickly be serviced.

In accordance with the first and simplified method of operation, old coolant is removed and replaced with new coolant by any of three methods, as set forth below.

The old coolant is removed via the tube or service hose 22 and new coolant is drawn into the tube. The partial vacuum produced in the coolant system draws new coolant into the radiator by the partial vacuum in the radiator and air pressure from the apparatus.

Old coolant may be re-used with reversal of processes by turning the main control knob 24 at the console momentarily, thus to pressurize the replacement coolant which is then passed into the radiator.

In a second method of operation, old coolant is removed as in the manner of the first method. Because a partial vacuum typically remains in the coolant system, new coolant, which is stored in a removable container or jug 36, can be readily allowed to flow into the vehicle radiator via the conduit or service hose 22 which is inserted into the radiator opening or into the coolant tank opening. The system of the invention is designed for continuous flow of new coolant into the radiator, a partial vacuum being constantly generated by the venturi 28.

Figure 4:
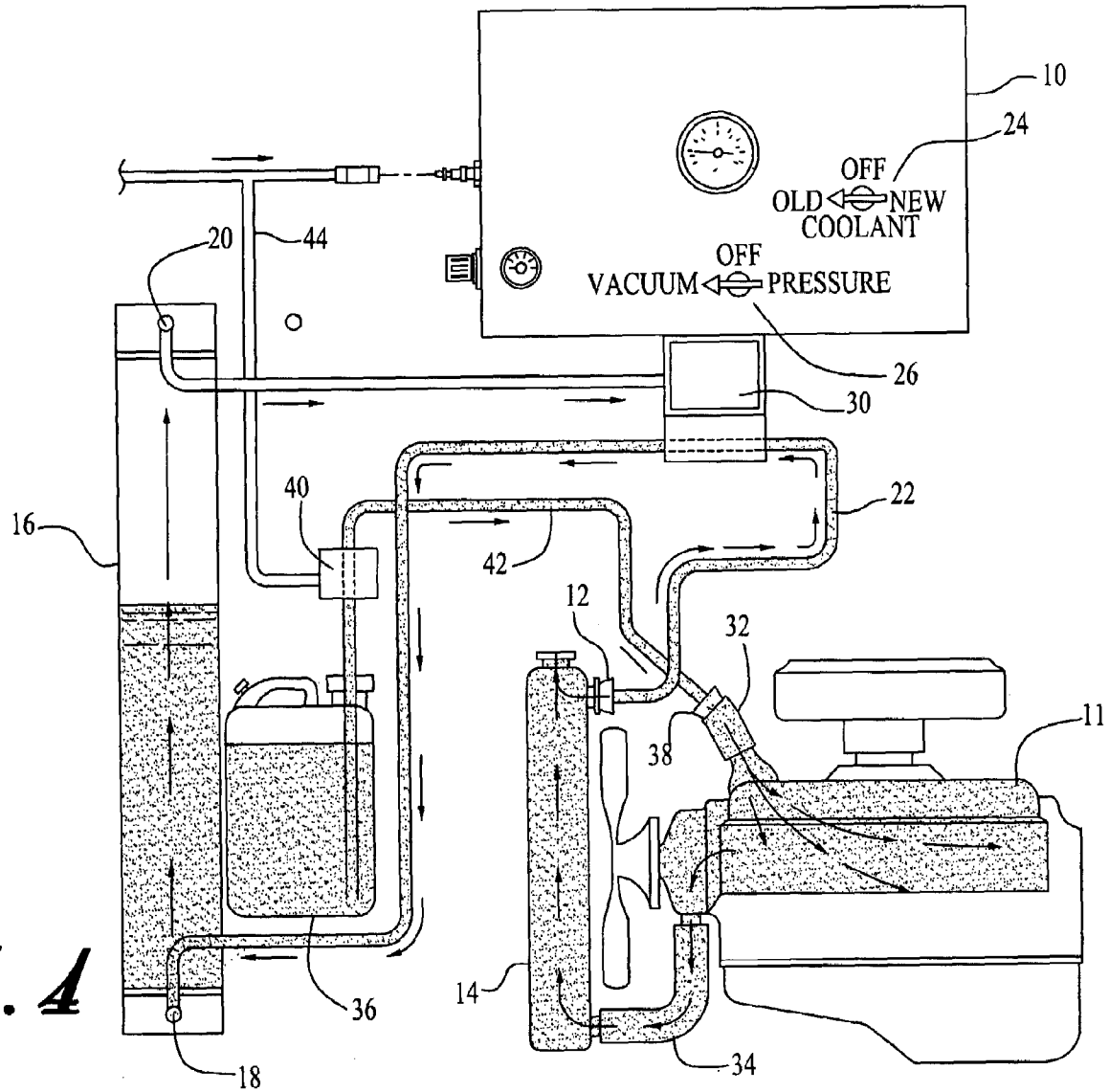
FIG. 4 is a diagrammatic showing of a modified arrangement according to the invention for reinsertion of new coolant into the vehicle engine.
Figure 5:
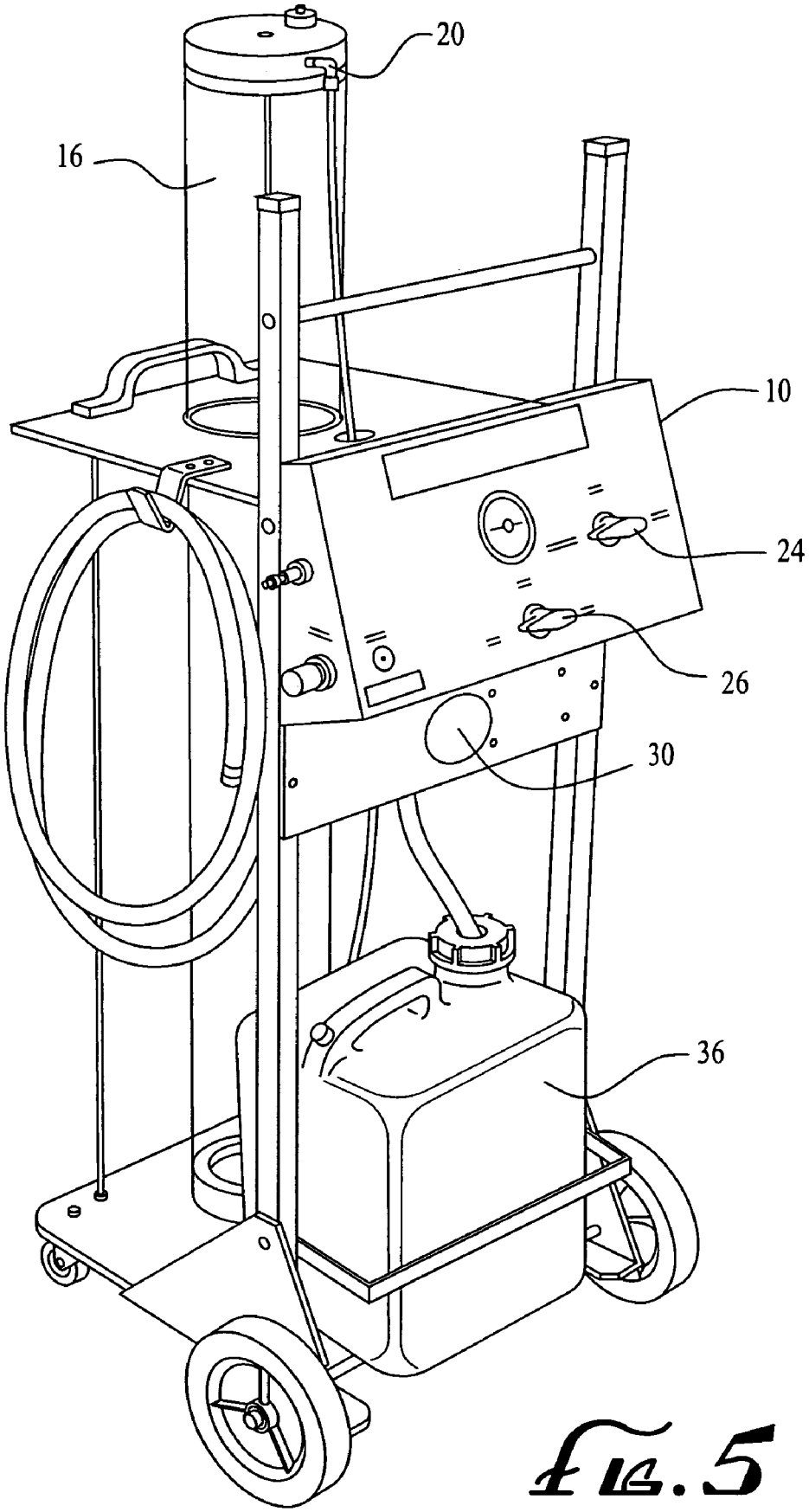
FIG. 5 is a perspective view of a console whereon components according to the invention are disposed.

A third mode of operation of the system requires removing one end of upper radiator hose 32. Referring to FIG. 4, if the thermostat (not shown) is aligned with the radiator hose, the hose end closest to the engine is removed. If the thermostat is aligned with the bottom radiator hose, the hose end closest to the radiator is removed.

A stepped adapter 38 is inserted into the end of the upper radiator hose 32 and is clamped to the upper radiator hose 32. An upper cone adapter 12 is inserted into the port from which the radiator hose 32 has been removed.

The main service line 22 is connected to cone 12 (FIG. 4) and the secondary service line 42 is connected to adapter 32, and a pump 40 is connected with a pressure line 44.

Old coolant is drawn from the radiator by the partial vacuum in old coolant tube 16, while new coolant is pumped into the radiator from reservoir or jug 36 by pressure from a pump 40 which is connected with the secondary service line 42 and adapter 38. The pump 40 is operated by pressure in line 44 which is connected with the control console.

Upon the completion of coolant replacement, old coolant in the storage tube 16 may be discharged by opening air pressure control knob 26 at the console 10, and old coolant is forced out of the tube via the main service line.

It will be understood that various changes and modifications may be made without departing from the scope of the present invention, which is established by the following claims and equivalents thereof.

The invention claimed is:

1. A vehicle engine coolant changing system comprising:

an old coolant container having an inlet opening and an outlet opening, a new coolant container having an inlet opening and an outlet opening, an adapter disposed in an engine radiator service opening and having a passage therethrough, the adapter has a tapered configuration to engage in service openings of various sizes, an old solution conduit interconnecting an engine interior and said inlet opening of the old coolant container for transfer of old coolant from the engine interior to the old coolant container, a new conduit interconnecting the new coolant container and the adapter to pass new coolant from the new coolant container into the engine by atmospheric pressure, means to provide a partial vacuum in the old coolant container to draw old coolant from the engine interior into the old coolant container via a conduit, means to apply atmospheric pressure to new coolant in the new coolant container to urge said coolant into the engine, and a single control operable to provide rapid and efficient changes in flow patterns via conduits and valves of the system.

2. A system according to claim 1, wherein said new coolant container is portable.

3. A system according to claim 1, wherein the inlet and outlet openings are respectively disposed in either (1) upper portions, (2) lower portions of said coolant containers.

4. A system according to claim 1, wherein removal of coolant from and insertion of new coolant into an engine are performed without disconnecting or reconnecting any conduit.

5. A system according to claim 1, wherein cleaning and flushing of a coolant system is effected concurrently with changing of the coolant.

6. A system according to claim 1, wherein said partial vacuum is produced by a venturi.

7. A vehicle engine coolant changing system comprising;

an old coolant container having an inlet opening in an outlet opening, a new coolant container having an inlet opening and an outlet opening, an adapter disposed in an engine radiator service opening and having a passage therethrough, an old solution conduit interconnecting an engine interior and said inlet opening of the old coolant container for transfer of old coolant from the engine interior to the old coolant container, a conduit interconnecting the new coolant container and the adapter, means to apply atmospheric pressure to new coolant in the new coolant container, to urge said coolant into the engine, an end of an upper radiator hose is disconnected, an upper cone adapter adapted to be didposed in a port from which, said radiator hose is removed, a stepped adapter adapted to be inserted into the upper radiator hose and clamped thereto, a main service line connected to said adapter in said engine radiator service opening and a pump connected with a pressure line, and old coolant being drawn from the vehicle radiator by a partial vacuum in said old solution container while new coolant is pumped into the radiator from the new coolant container by a pump connected with a secondary service line and the adapter, the pump being operated by pressure via a control.

8. A system according to claim 7, wherein said new coolant container is portable.

9. A system according to claim 7, wherein said adapter has a tapered configuration to engage in service openings of various sizes.

10. A system according to claim 7, wherein cleaning and flushing of a coolant system is effected concurrently with changing of the coolant.

11. A system according to claim 7, wherein said partial vacuum is produced by a pump.

12. A system according to claim 7, wherein said partial vacuum is produced by a venturi.

13. A system according to claim 7, wherein said old coolant container is sealed at its top and bottom.

14. A system according to claim 7, wherein said new and old coolant containers and control valves are disposed on a console.

15. A system according to claim 7, wherein a single control is operable to provide rapid and efficient changes in flow patterns via conduits and valves of the system.

* * * * *